US011410635B1

(12) United States Patent
Dileone, Jr.

(10) Patent No.: US 11,410,635 B1
(45) Date of Patent: Aug. 9, 2022

(54) ADJUSTABLE CAPSTAN FOR AN ELECTRIC PIANO ACTION

(71) Applicant: Vintage Vibe LLC, Rockaway, NJ (US)

(72) Inventor: Alfred J. Dileone, Jr., Hamden, CT (US)

(73) Assignee: Vintage Vibe LLC, Rockaway, NJ (US)

( * ) Notice: Subject to any disclaimer, the term of this patent is extended or adjusted under 35 U.S.C. 154(b) by 0 days.

(21) Appl. No.: 17/684,097

(22) Filed: Mar. 1, 2022

Related U.S. Application Data

(63) Continuation of application No. 17/532,748, filed on Nov. 22, 2021.

(51) Int. Cl.
*G10C 3/18* (2006.01)
*G10C 3/12* (2006.01)
*G10H 1/34* (2006.01)

(52) U.S. Cl.
CPC ..... *G10C 3/18* (2013.01); *G10C 3/12* (2013.01); *G10H 1/344* (2013.01)

(58) Field of Classification Search
CPC ..... G10C 3/18; G10C 3/12; G10H 1/344
See application file for complete search history.

(56) References Cited

U.S. PATENT DOCUMENTS 2,214,112 A * 9/1940 Schulze ..... G10C 3/22 84/239
2,469,667 A 5/1949 Rhodes
2,919,616 A 1/1960 Miessner
2,932,231 A 4/1960 Miessner
2,942,512 A 6/1960 Miessner
2,966,821 A 1/1961 Miessner
2,972,922 A 2/1961 Rhodes
3,038,363 A 6/1962 Miessner
3,041,909 A 7/1962 Miessner
3,077,137 A 2/1963 Miessner
3,270,608 A 9/1966 Rhodes
3,285,116 A 11/1966 Rhodes
3,384,699 A 5/1968 Rhodes
3,418,417 A 12/1968 Rhodes
3,541,915 A 11/1970 Rhodes
3,644,656 A 2/1972 Fender et al.
4,342,246 A 8/1982 Rhodes et al.
4,373,418 A 2/1983 Rhodes et al.
5,406,875 A * 4/1995 Tamai ..... G10H 1/344 84/719
6,639,133 B1 * 10/2003 Wroblewski ..... G10C 3/22 84/241
9,514,725 B1 12/2016 Brandstetter et al.

* cited by examiner

*Primary Examiner* — Jianchun Qin

(74) *Attorney, Agent, or Firm* — Pearl Cohen Zedek Latzer Baratz LLP

(57) ABSTRACT

An adjustable action for an electric piano is provided with a keystick having an adjustable bottom capstan at an end thereof opposite the key, which is adjustable so that the rest position of the hammer of each such key may be independently adjusted, and an adjustable top capstan and hammer jack on the top of the keystick, which may be adjusted so that the stop-lock (depressed key) position of the hammer of each such key may be independently adjusted.

15 Claims, 6 Drawing Sheets

ADJUSTABLE CAPSTAN FOR AN ELECTRIC PIANO ACTION

CROSS-REFERENCE TO RELATED APPLICATIONS

This application is a continuation of U.S. patent application Ser. No. 17/532,748 filed Nov. 22, 2021, which is hereby incorporated by reference.

BACKGROUND OF THE INVENTION

U.S. Pat. Nos. 3,270,608 and 4,338,848 both describe a Rhodes-style electric piano action used in all production Fender Rhodes and Rhodes electric pianos produced from 1965 to 1984. The actions described in these patents and those used in production utilize a keystick with a solid pedestal on an end of the keystick opposite the key that elevates and accelerates a hammer to strike a tone source. When a key is depressed by the pianist, the pedestal end of the keystick rises, exerting upward motion to a hammer cam. The hammer strikes the tone source and is returned to a position below and out of contact with the vibrating tone source. This distance between the tone source and the hammer after striking is referred to as "escapement". Due to pressure applied between the rear of the pedestal and the hammer cam, a brake effect is applied to the hammer at the end of a key stroke. This is referred to as "stop-lock", and provides escapement while preventing hammer bounce, which would result in muted tone. Conventionally, it has not been possible to register individual key dip and hammer height at rest or adjust the hammer position at the stop-lock escapement position of individual keys.

SUMMARY OF THE INVENTION

These drawbacks are addressed in one aspect of the invention with a piano action comprising: a keystick having a key end adapted to be depressed from a rest position by a user and a pedestal end opposite the key end adapted to rise when the key end is depressed by a user; said keystick being supported at a fulcrum point of the keystick on a balance rail; a hammer having a hammer cam surface positioned above and contacting the pedestal end of the keystick, said hammer adapted to rise to strike a sound-producing element and return a stop-lock position; a top capstan extending vertically upward from the pedestal end of the keystick and having a surface contacting a brake portion of the hammer cam surface in the stop-lock position; a hammer jack extending from a top surface of the key stick inboard of the top capstan and contacting a cam portion of the hammer cam surface in the rest position; wherein the top capstan is adjustable vertically to adjust an escapement distance of the hammer from the sound-producing element. The electric piano action according to the invention may further comprise a bottom capstan extending vertically downward from the pedestal end of the keystick and having a surface contacting a piano back rail in the rest position. The bottom capstan may be rotatable in the keystick to adjust a height of the bottom capstan. In embodiments, the longitudinal position of the hammer jack on the key stick may be made adjustable.

The height of the top and bottom capstans and the longitudinal position of the hammer jack with respect to the top capstan may be used to regulate key dip, hammer throw, and escapement of individual keys to optimize tone and suit preferences of individual users.

In another aspect, the invention is embodied as a method of adjusting a piano action of an electric piano, said electric piano comprising a plurality of keys and corresponding keysticks in a horizontal array, each said keystick having a key end adapted to be depressed from a rest position by a user to raise a pedestal end of the keystick opposite the key end; a first set of said plurality of keysticks being supported on a balance rail at a first fulcrum point of said first set of keysticks; and a second set of said plurality of keysticks being supported on a balance rail at a second fulcrum point of said second set of keysticks; a plurality of hammers, each hammer having a respective hammer cam surface positioned above the pedestal end of a respective keystick, a plurality of bottom capstans extending vertically downward from the pedestal end of each respective keystick and resting on a surface in the rest position; wherein each bottom capstan is adapted to be rotated to adjust a height of the bottom capstan from a bottom surface of the keystick; and a plurality of top capstans extending vertically upward from the pedestal end of each respective keystick, each top capstan having a respective surface contacting a brake portion of a respective hammer cam surface in the stop-lock position; and a hammer jack extending vertically upward from a top surface of each keystick, inboard of the top capstan, and contacting a curved surface of a respective hammer cam surface; wherein the top capstan is adapted to be rotated to adjust a height of each respective top capstan above a top surface of each respective key strip; the method comprising, in any order: rotating at least one bottom capstan until two or more keys in the horizontal array are flush with one another in the rest position; rotating at least one the top capstan until an escapement distance of at least two hammers is the same in the stop-lock position;

In embodiments, the method of modifying the piano action comprises moving the hammer jack in a longitudinal direction on the keystick to increase or decrease the hammer throw without increasing or decreasing key dip.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
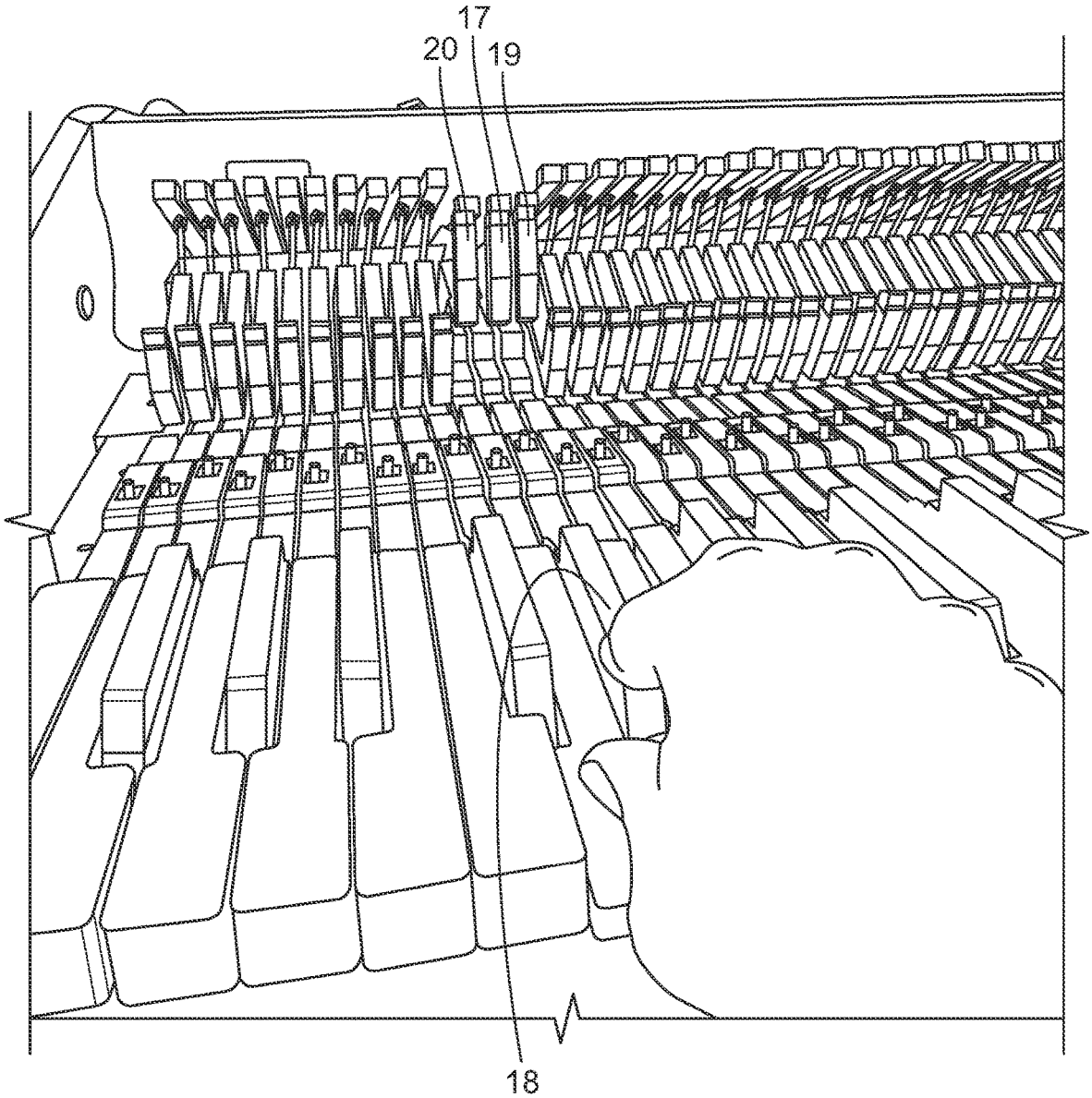
FIG. 1 depicts a typical prior art Fender Rhodes/Rhodes electric piano action.

It will be appreciated that for simplicity and clarity of illustration, elements shown in the figures have not necessarily been drawn to scale and some elements not necessary for an understanding of the invention have been omitted. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Orienting directions herein, such as "up" and "down," and "vertical" and "horizontal," are approximate and relative to a piano as normally used and played for the purpose of generally orienting the elements in the description. Thus, in an electric piano described herein, the keyboard is a "horizontal" array of keys; the keys are pressed in a "downward" direction, and the hammer is "above" the keystick, and "rises vertically" to strike a sound-producing element above the hammer.

In an electric piano, a keystick is an elongated element having a key at one end and a pedestal at an opposite end which engages a hammer to strike the sound-producing element, called a "tine." The longitudinal direction of the keystick is from the key end toward the pedestal end; "inboard" means inward of the ends and toward the middle of the keystick. The keystick is supported at a fulcrum position of the keystick on a balance rail. Because sharp keys are shorter than natural keys, one set of keysticks has a different fulcrum position than another set. At a rest position, the pedestal end sits on the chassis or back rail, and when a key is depressed after striking a tine the hammer returns to the "stop-lock" position while the key is depressed.

The inventor herein became aware of an inherent flaw in the conventional electric piano design (such as the Rhodes), in that there is no ability to adjust the regulation at rest of individual keys. In a conventional electric piano design, natural and sharp hammers that are level at rest are not level in the depressed position. This is because of the tapered height balance rail present in the traditional piano key bed, which is the fulcrum point between the pedestal end of the keystick and the key at the opposite end. All individual piano keys, naturals and sharps, are situated on the balance rail at an angle conventionally about 5°, dictating the angle of the balance rail. As sharp keysticks are shorter than naturals, the fulcrum point is positioned away from the pianist on the sharp keys to provide more consistent key balance and allowing for more consistent downward pressure required to depress sharps vs. natural keys. Due to the taper in height of the balance rail, however, the fulcrum point of the sharp keys sits lower than that of the natural keys. Therefore, when natural and sharp keys are level at the rest position (which is tilted toward the piano bed about 5°), once depressed, the sharp key itself sits lower than the natural, and so then does its pedestal end, which in turn, supports the hammer of the sharp key lower in the depressed key position, which finally translates to a greater escapement than that of the natural counterpart. Further, conventional electric pianos do not allow adjustment of the escapement distance (defined as the distance between the hammer and the sound producing element) in the stop-lock position for individual keys. In an electric piano. where the hammer cams are directly actuated by the rising pedestal, the hammers of sharp keys often have a lower stop-lock position than natural keys, because the sharp keys have a shorter length than the natural keys and are pivoted over the balance rail at a lower position. This results in greater escapement distance than the natural keys, with no adjustment available to compensate for inconsistencies of the escapement distance. Other causes may result in inconsistent hammer height, including a drift in tolerances. In the prior art, there is no ability to adjust individual action components for optimal performance.

FIG. 1 depicts a conventional electric piano action with the keys depressed and the keystick and hammer of the depressed keys in the stop-lock position. Typically, in such cases, hammer 17 corresponding to sharp key 18 has lower stop-lock position (greater escapement distance) than its near neighbors (19, 21). At present, there is no means for individual correction of this setting.

Figure 2:
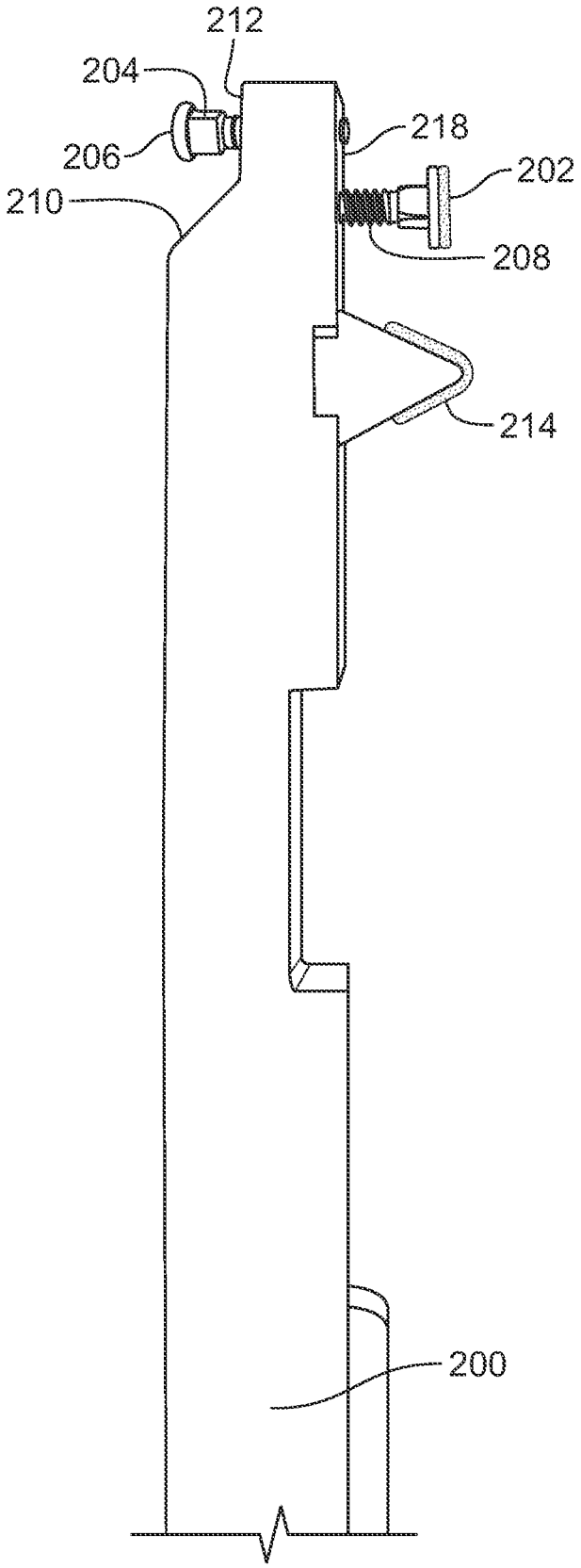
FIG. 2 schematically depicts a keystick having top and bottom capstans according to embodiments of the invention.

FIG. 2 depicts an adjustable keystick 200 according to embodiments of the invention wherein the distance or height from bottom contact surface 206 of bottom capstan 204 to bottom surface 212 at the end of keystick 200 adjusts the level of the keys at rest. A keystick having only the bottom capstan, originally developed by the inventor herein, is known in the prior art. Older designs did not allow for adjustment of this height in individual keys. In embodiments, a cutaway 210 is provided in the profile of the bottom of keystick 200 so that surface 212 into which bottom capstan 204 is received is offset from the bottom of the keystick to allow space for the bottom capstan to be received and adjusted. Contact surface 206 provided at the bottom of capstan 204 may be curved to allow support on the piano bed or a receiving surface (sometimes called a "back rail"). In this embodiment, bottom capstan 204 can be received in a threaded recess or through hole at the end of key stick 200. While the exact dimension is not critical, the length of the entire bottom capstan 204 may be about 22 mm and allows for adjustment up to +/−3 or 4 mm.

Top capstan 208, positioned slightly inboard of bottom capstan at the end of keystick 200, adjusts the level of the hammer at the stop-lock position. Similarly to bottom capstan 204, top capstan 208 can be received in a threaded recess or through hole at the end of keystick 200 through the top surface 218. Hammer 302 (as described below) contacts head 202 of top capstan 208. Hammer jack 214, inboard of top capstan 208, supports hammer 302 in the rest position.

Figure 3:
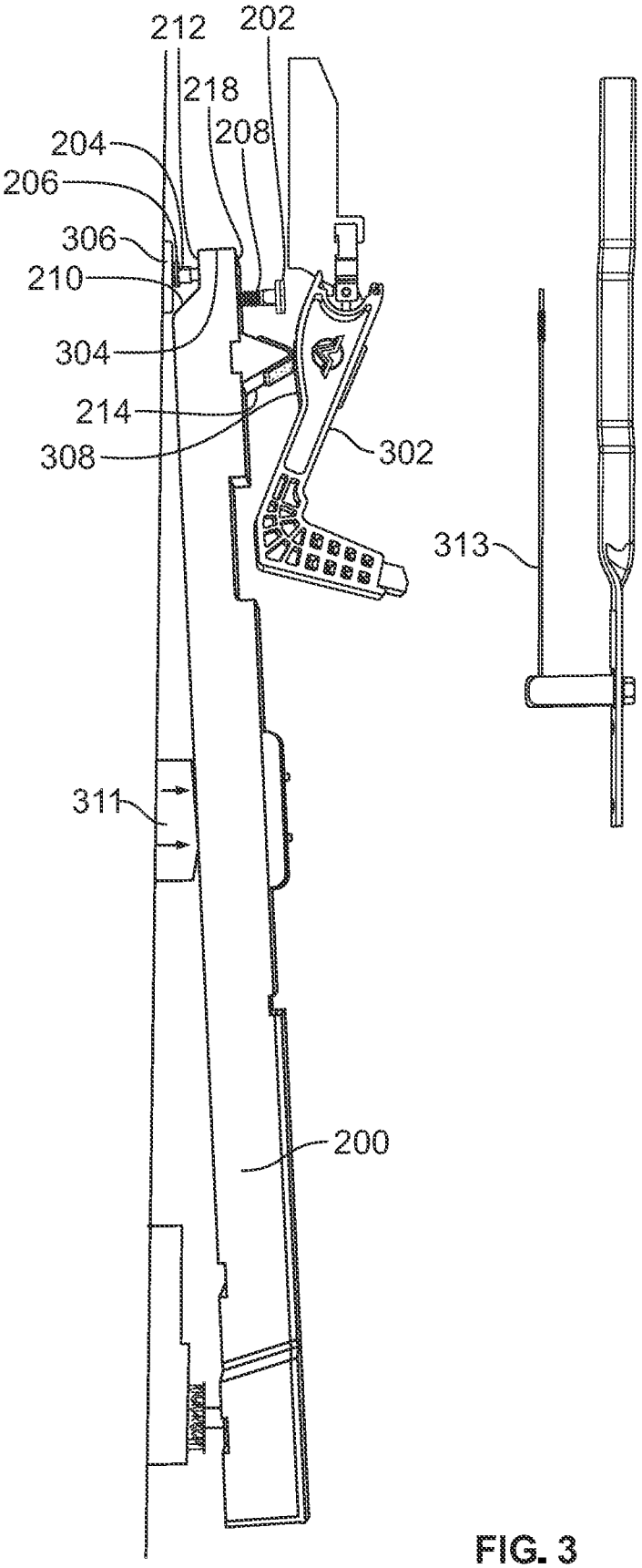
FIG. 3 schematically depicts a keystick having top and bottom capstans and the interactions with the hammer at the rest position.

The dual capstan arrangement depicted in FIG. 3 provides an adjustment to compensate for the hammer height differences in the rest position and additionally allows individual key dip adjustments, adjustments to hammer throw and adjustments to escapement distance for individual keys. In the embodiment shown in FIG. 3, pedestal end 304 of keystick 200 and hammer 302 are in the rest position. In this position, keystick 200 rests on balance rail 311 such that bottom capstan 204 lies on the piano back rail 306 with the top of hammer jack 214 contacting hammer cam surface 308 at a contact point 310 on a curved surface thereof. In one embodiment, tightening the bottom capstan 204 into the keystick lowers jack 214, and thus, lower hammer 302 at rest. The desired effect on hammer 302 has an opposite effect on key leveling, and can be compensated with conventional shimming of key stick 200, as known in the art.

Figure 4:
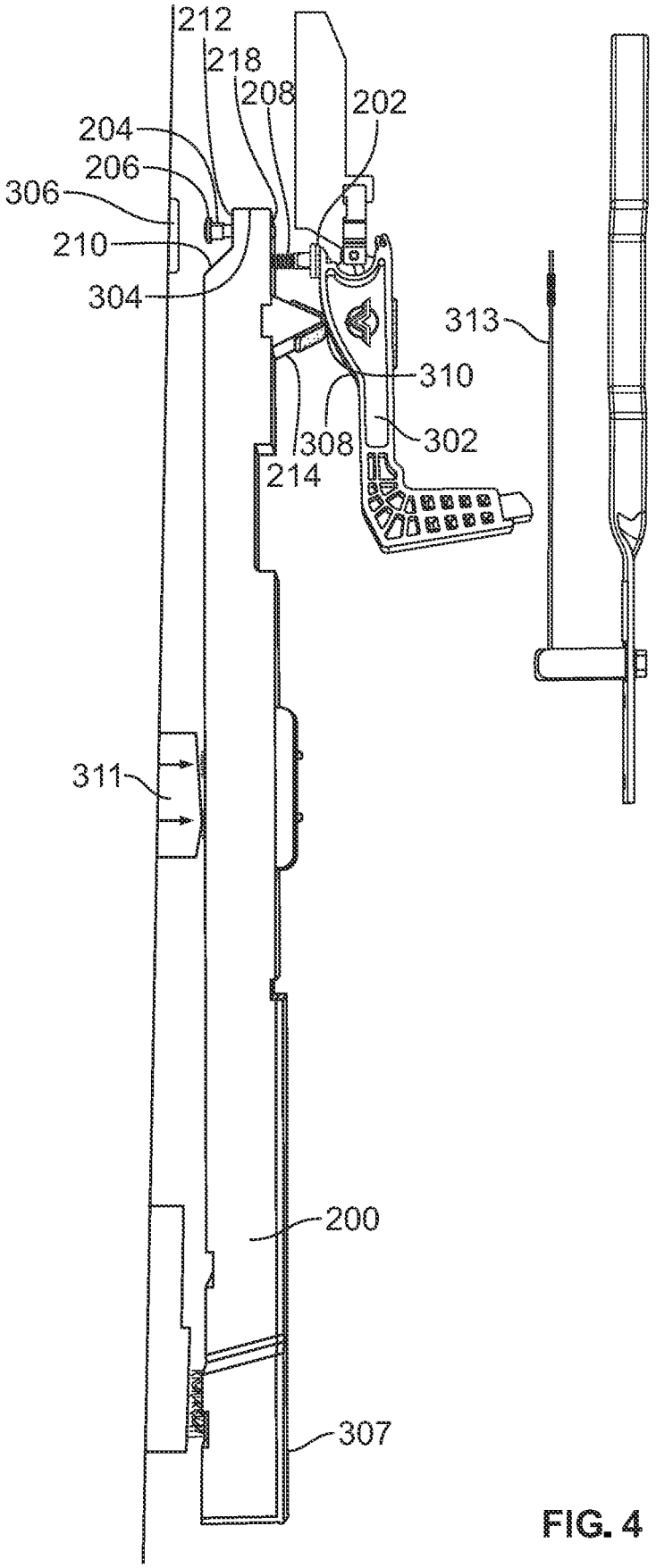
FIG. 4 schematically depicts a keystick having top and bottom capstans and the interactions with the hammer at the stop-lock position.

The upper capstan arrangement depicted in FIG. 4 provides an adjustment to compensate for the hammer height differences in the stop-lock position and allows individual escapement adjustments and braking characteristics for every key. In the embodiment shown in FIG. 4, pedestal end 304 of keystick 200 and hammer 302 are in the stop-lock position after a note has been struck. In this position, bottom capstan 204 is raised off piano back rail 306 by depressing the key. Depressing a key on keyboard causes hammer jack 214 to lift hammer 302 and slide along hammer cam surface 308, "throwing" hammer 302 to strike tine 313 in the last portion of travel and then returning to the natural brake position shown. Top capstan 208 is inboard of bottom capstan 204 and has adjustable height. The use of top capstan 208 provides an adjustable stop-lock height (hammer height in depressed key position), allowing for individual escapement settings for each key, resulting in more accurate regulation of the action. As braking is congruous with stop-lock height, individual braking characteristics of each key are also adjustable. In embodiments, unscrewing (raising) top capstan 208 allows the hammer cam 308 to pivot on the jack 214 resulting in a lower hammer height in stop-lock position (increased escapement). Tightening (lowering) top capstan 208 will result in a higher hammer height in stop-lock position (decreased escapement). In embodiments, top capstan 208 comprises a stem and an integral head 202, having a slight oversize diameter in comparison to the hammer cam 308 width, which allows for additional adjustment possibilities, and provides compensation for drift in tolerances during assembly of the piano. (Drift in tolerances may occur for example in on-center spacing between hammer cams and key pedestals as may be apparent to the artisan having ordinary skill). In addition to initial establishment of hammer height in the stop-lock position and the ability to match all hammers heights in stop-lock, problematic notes, such as those displaying double strike issues (often due to improper strike line on a particular note, with inconsistencies in tine 313 often to blame) can be individually adjusted for optimal performance. Lowering the hammer height at stop-lock, which effectively applies brake of the hammer further from tine 313 reduces the effect of a bouncing hammer due to improper rebound, thus preventing double striking.

As shown in FIGS. 3 and 4, hammer jack 214 comprises a bull nose contact surface 310 with the curved portion of hammer cam surface 308 at a contact point thereof. A cushioning material such as felt, polymer or other material may be provided on the hammer jack contact point, on integral head 202 of top capstan 208, or both.

In embodiments, the longitudinal position of hammer jack 214 may be moved longitudinally on keystick 200, for example by providing a plurality of joining positions on a top surface 218 of keystick 200. Varying the position of hammer jack 214 relative to top capstan allows throw of hammer 302 to be adjusted without impacting key dip. The "throw" of the hammer is the last portion of the travel of the hammer, during which the hammer is carried by momentum toward tine 313. The key "dip" is the amount that the key can be depressed, an important parameter for the feel of the piano, preferably constant from key to key and standardized to 13/32 inch in most applications.

Figure 5:
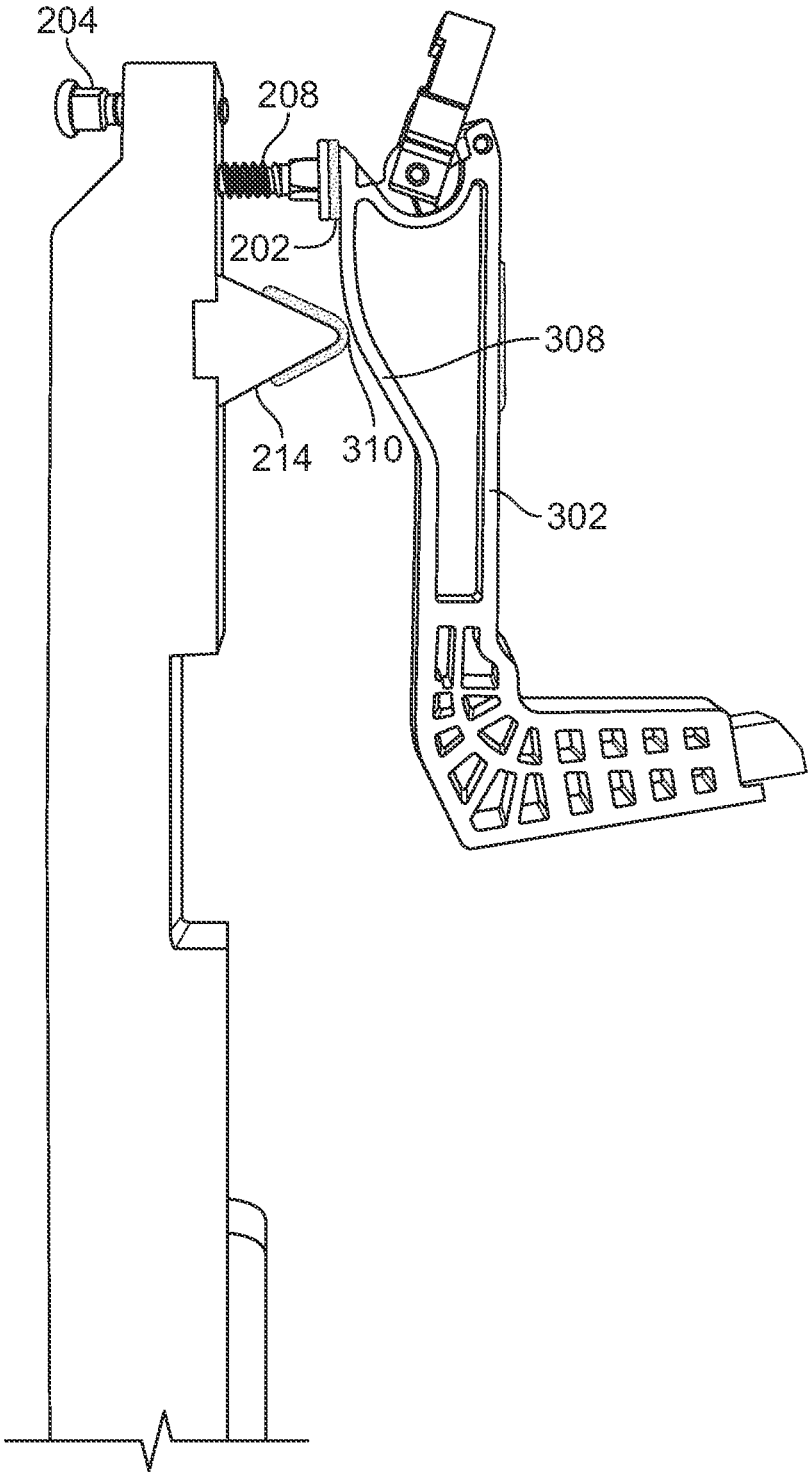
FIG. 5 schematically depicts the interactions with the hammer at an increased height of the top capstan.

FIG. 5 depicts an extremely high adjustment of top capstan 208. The high adjustment of top capstan 208 results in overly light braking and allowing "aftertouch"—a vague sensation at the end of the key stroke due to lack of the jack assisting in proper setup of the braking effect on the hammer There is a gap between contact point 310 and the top of hammer jack 214. A height of top capstan 208 close in height to hammer jack 214 will result in a more subtle brake, as the hammer jack 214 is applying less pressure to the forward section of the hammer cam 308. This forward cam pressure is what ultimately holds the rear bottom of the hammer cam 308 firmly against integral head 202 of top capstan 208. In the way, top capstan 208 in combination with hammer jack 214 can be used to adjust braking action in addition to adjusting hammer height in stop lock position. FIG. 5 depicts "after touch."

Figure 6:
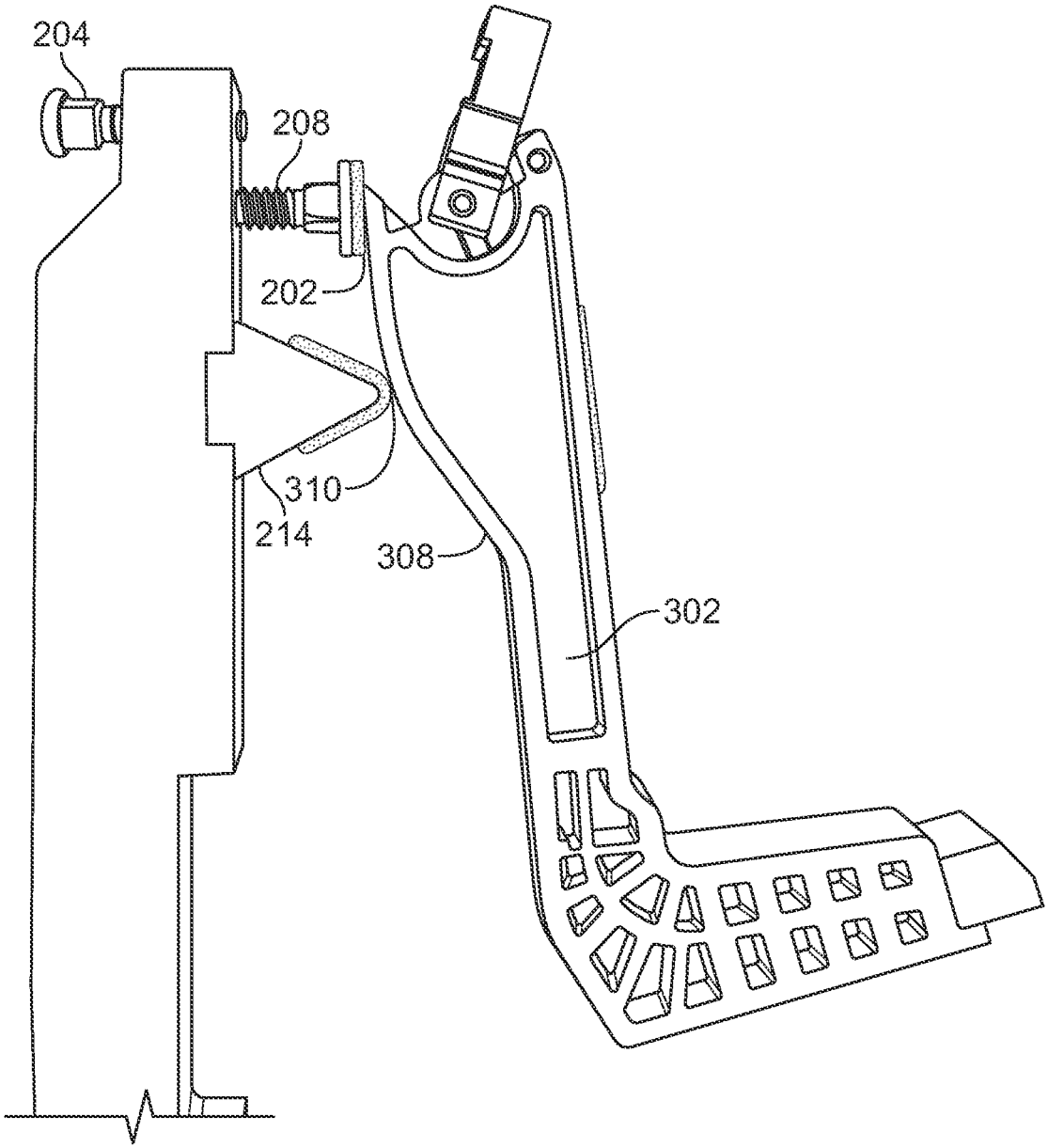
FIG. 6 schematically depicts the interactions with the hammer at a decreased height of the top capstan.

FIG. 6, in contrast, depicts a very aggressive brake action setting. Setting top capstan 208 to a lower height relative to hammer jack 214, as depicted in FIG. 6, increases hammer height and key dip. As hammer jack 214 is now forcing the rear edge of the hammer cam 308 into integral head 202 of top capstan 208, brake effect will also be enhanced.

In another embodiment, top capstan 208 can serve in fine tuning of hammer throw (travel) and very fine key dip adjustments in initial setup of the action. Lowering top capstan 208 increases hammer throw and thus key dip. Raising has the opposite effect.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A piano action comprising:

a keystick having a key end adapted to be depressed from a rest position by a user and a pedestal end opposite the key end adapted to rise when the key end is depressed by a user;

said keystick being supported at a fulcrum point of the keystick on a balance rail;

a hammer having a hammer cam surface positioned above and contacting the pedestal end of the keystick, said hammer adapted to rise to strike a sound-producing element and return to a stop-lock position in which the key end is depressed and held down;

a top capstan extending vertically upward from the pedestal end of the keystick and having a surface contacting a brake portion of the hammer cam surface in the stop-lock position;

a hammer jack extending from a top surface of the keystick inboard of the top capstan and contacting a cam portion surface of the hammer cam surface in the rest position; wherein the top capstan is adjustable vertically to adjust an escapement distance and timing of brake application of the hammer from the sound-producing element.

2. The piano action according to claim 1, wherein the hammer jack has-two sloped sides meeting at a peak.

3. The piano action according to claim 1, wherein the hammer jack and the top capstan are covered with a cushioning material.

4. The piano action according to claim 1, wherein the top capstan is threaded into the keystick and wherein a height of a top surface of the top capstan above the keystick is adjustable by rotating the top capstan.

5. The piano action according to claim 1, wherein the top capstan comprises a stem in threaded relationship with a recess in a top surface of the keystick, and a head integral with and having a larger diameter than the stem.

6. The piano action according to claim 1, further comprising a bottom capstan extending vertically downward from the pedestal end of the keystick and having a surface adapted to contact a piano back rail in the rest position, said bottom capstan being rotatable in the keystick to adjust a height of the bottom capstan.

7. The piano action according to claim 1, wherein the keystick is provided with a plurality of hammer jack joining positions along a length of the keystick providing for longitudinal adjustment on the hammer jack on the keystick.

8. A piano action comprising:

a plurality of keys and corresponding keysticks in a horizontal array, each said keystick having a key end adapted to be depressed from a rest position by a user to raise a pedestal end of the keystick opposite the key end when the key end is depressed by a user;

a first set of said plurality of keysticks being supported on a balance rail at a first fulcrum point of said first set of keysticks;

a second set of said plurality of keysticks being supported on a balance rail at a second fulcrum point of said second set of keysticks;

a plurality of hammers, each hammer having a respective hammer cam surface positioned above the pedestal end of a respective keystick, a plurality of bottom capstans extending vertically downward from the pedestal end of each respective keystick and resting on a surface; wherein each bottom capstan has an adjustable height, adapted so that said first set of said plurality of keysticks aligns with said second set of said plurality of keysticks at a rest position and at a depressed position, notwithstanding that said first and second fulcrum points of said first and section sets of keysticks on the balance rail are different;

a top capstan extending vertically upward from the pedestal end of each respective keystick and each top capstan having a respective surface contacting a brake portion of a respective hammer cam surface in the stop-lock position in which the respective key is depressed and held down; and a hammer jack extending vertically upward from a top surface of each keystick, inboard of the top capstan, and contacting a curved surface of a respective hammer cam surface; wherein the top capstan is adjustable vertically to adjust an escapement distance and timing of brake application of the hammer from the sound-producing element in the stop-lock position.

9. The piano action according to claim 8, wherein each keystick is provided with a plurality of respective hammer jack joining positions along a length of the keystick providing for longitudinal adjustment on the hammer jack on the keystick.

10. The piano action according to claim 8, wherein each hammer jack has-two sloped sides meeting at a peak.

11. The piano action according to claim 8, wherein each hammer jack and each top capstan are covered with a cushioning material.

12. The piano action according to claim 8, wherein each top capstan is threaded into a respective keystick and wherein a height of a respective top surface of each respective top capstan above the keystick is adjustable by rotating the respective top capstan.

13. The piano action according to claim 8, wherein each top capstan comprises a stem in threaded relationship with a recess in a top surface of the keystick, and a respective head integral with and having a larger diameter than the stem.

14. A method of adjusting a piano action of an electric piano, said electric piano comprising a plurality of keys and corresponding keysticks in a horizontal array, each said keystick having a key end adapted to be depressed from a rest position by a user to raise a pedestal end of the keystick opposite the key end; a first set of said plurality of keysticks being supported on a balance rail at a first fulcrum point of said first set of keysticks; and a second set of said plurality of keysticks being supported on a balance rail at a second fulcrum point of said second set of keysticks; a plurality of hammers, each hammer having a respective hammer cam surface positioned above the pedestal end of a respective keystick, a plurality of bottom capstans extending vertically downward from the pedestal end of each respective keystick and resting on a surface in the rest position; wherein each bottom capstan is adapted to be rotated to adjust a height of the bottom capstan from a bottom surface of the keystick; and a plurality of top capstans extending vertically upward from the pedestal end of each respective keystick, each top capstan having a respective surface contacting a brake portion of a respective hammer cam surface in the stop-lock position in which the respective key is depressed and held down; and a hammer jack extending vertically upward from a top surface of each keystick, inboard of the top capstan, and contacting a curved surface of a respective hammer cam surface; wherein the top capstan is adapted to be rotated to adjust a height of each respective top capstan above a top surface of each respective keystick;

the method comprising, in any order:

rotating at least one bottom capstan until two or more keys in the horizontal array are flush with one another in the rest position;

rotating at least one the top capstan to adjust a brake application timing and until an escapement distance of at least two hammers is the same in the stop-lock position.

15. The method of adjusting an action of an electric piano according to claim 14, further comprising moving the hammer jack in a longitudinal direction on the keystick to increase or decrease the hammer throw without increasing or decreasing key dip.

* * * * *